US009784532B1

(12) United States Patent
Sisemore et al.

(10) Patent No.: US 9,784,532 B1
(45) Date of Patent: Oct. 10, 2017

(54) MISSILE LAUNCHER SYSTEM FOR RELOAD AT SEA

(71) Applicants: Carl L. Sisemore, Cedar Crest, NM (US); Eric A. Wheater, King George, VA (US); Joseph M. Plaia, Fredericksburg, VA (US); Thomas E. Bohlmann, Port Royal, VA (US); Charles N. Flemmings, Brandywine, MD (US); Scott A. Wastweet, Ventura, CA (US)

(72) Inventors: Carl L. Sisemore, Cedar Crest, NM (US); Eric A. Wheater, King George, VA (US); Joseph M. Plaia, Fredericksburg, VA (US); Thomas E. Bohlmann, Port Royal, VA (US); Charles N. Flemmings, Brandywine, MD (US); Scott A. Wastweet, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/136,987

(22) Filed: Apr. 25, 2016

Related U.S. Application Data

(62) Division of application No. 14/289,497, filed on May 28, 2014, now abandoned.

(51) Int. Cl.
*F41F 3/04* (2006.01)
*F41F 3/00* (2006.01)

(52) U.S. Cl.
CPC ..... *F41F 3/0413* (2013.01)

(58) Field of Classification Search
CPC ..... F41F 3/0413; F41F 3/073; F41F 3/077; F41F 3/04
USPC ..... 89/1.8–1.819
See application file for complete search history.

(56) References Cited

U.S. PATENT DOCUMENTS

| | | | | |
|---|---|---|---|---|
| 2,816,483 A | | 12/1957 | Johnston | 89/1.817 |
| 3,228,295 A | * | 1/1966 | Kane | F41A 9/20 89/1.802 |
| 3,477,338 A | | 11/1969 | Bauer et al. | 89/1.805 |
| 4,044,648 A | | 8/1977 | Piesik | 89/1.8 |
| 4,134,327 A | | 1/1979 | Piesik | 89/1.8 |
| 4,324,167 A | | 4/1982 | Piesik | 89/1.8 |
| 4,471,684 A | | 9/1984 | Johnson et al. | 89/1.815 |
| 4,686,884 A | | 8/1987 | Piesik | 89/1.816 |
| 4,934,241 A | | 6/1990 | Piesik | 89/1.817 |

(Continued)

*Primary Examiner* — Michael David
(74) *Attorney, Agent, or Firm* — Gerhard W. Thielman, Esq.

(57) ABSTRACT

A missile launcher is provided for ship integration. In particular, the missile launcher affords a simple and safe integration onto a surface, such as a deck of a naval vessel, for example. The missile launcher includes a box launcher to house and launch the missiles and a pedestal to support and orient the box launcher. The box launcher provides protection from the natural environment as well as protection from other threats to the system. The box launcher is designed to enable missiles not normally designed for use in a harsh environment to be used in such an environment. The missile launcher also enables loading of missiles while at sea. The missile launcher can be integrated into naval vessels, land vehicles, fixed locations and other installations, as needed.

12 Claims, 6 Drawing Sheets

(56) References Cited

U.S. PATENT DOCUMENTS

| | | | | |
|---|---|---|---|---|
| 5,020,412 | A | 6/1991 | Adams | 89/1.805 |
| 5,036,770 | A | 8/1991 | Llewellin et al. | 102/293 |
| 5,094,140 | A | 3/1992 | Williams | 89/1.819 |
| 5,136,922 | A | 8/1992 | Piesik | 89/1.812 |
| 5,153,367 | A | 10/1992 | Markquart et al. | 89/1.8 |
| 5,162,605 | A | 11/1992 | Piesik | 89/1.817 |
| 5,837,917 | A | 11/1998 | Macnab et al. | 89/1.8 |
| 5,847,307 | A | 12/1998 | Kennedy et al. | 89/1.817 |
| 5,942,713 | A | 8/1999 | Basak | 89/1.816 |
| 6,376,762 | B1 | 4/2002 | French et al. | 114/22 |
| 6,543,328 | B1 | 4/2003 | Plummer et al. | 89/1.54 |
| 6,691,600 | B2 | 2/2004 | Boudreau et al. | 89/1.815 |
| 6,755,111 | B2 | 6/2004 | Ciappi | 89/1.817 |
| 7,313,995 | B2 | 1/2008 | Shah et al. | 89/1.815 |
| 7,913,605 | B2 | 3/2011 | Mercier | 89/1.819 |
| 8,266,999 | B1 | 9/2012 | Sisemore et al. | 89/1.815 |
| 8,302,524 | B2 | 11/2012 | Morse et al. | 89/1.81 |
| 8,397,613 | B2 | 3/2013 | Skurdal et al. | 89/1.8 |
| 8,443,707 | B2 | 5/2013 | Skurdal et al. | 89/1.805 |
| 8,468,924 | B2 | 6/2013 | Skurdal et al. | 89/1.819 |
| 9,255,399 | B2 * | 2/2016 | Ruan | |
| 2003/0000371 | A1 | 1/2003 | Ciappi | 89/1.817 |
| 2009/0126556 | A1 * | 5/2009 | Skurdal | F41F 3/04 89/1.817 |
| 2010/0236391 | A1 | 9/2010 | Baldi et al. | 89/1.815 |
| 2012/0152090 | A1 | 6/2012 | Skurdal et al. | 89/1.8 |
| 2012/0152092 | A1 | 6/2012 | Skurdal et al. | 89/1.819 |
| 2014/0060296 | A1 * | 3/2014 | Monteil | F41F 3/042 89/1.801 |
| 2015/0053073 | A1 | 2/2015 | Kalms et al. | 89/1.819 |

* cited by examiner

MISSILE LAUNCHER SYSTEM FOR RELOAD AT SEA

The invention is a Division, claims priority to and incorporates by reference in its entirety U.S. patent application Ser. No. 14/289,497 filed May 28, 2014 and assigned Navy Case 102188.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to missile launcher systems. In particular, the invention relates to missile launcher systems used to deploy missiles on a naval vessel, for example.

Naval vessels are often outfitted with missile launching systems for launching a missile from the vessel. Conventional launchers include the armored box launcher and a larger capacity vertical launching system. Such conventional launcher systems, however, cannot be reloaded at sea. Typically, vessels carrying such missile launchers must return to port to be reloaded. Moreover, these missile launchers are designed for large vessels and may not be suitable for deployment on smaller platforms, such as a coastal patrol craft.

Additionally, many conventional missile launchers are not designed for the harsh conditions of salt and water present while at sea. Hence, there is a need for a missile launcher that can withstand marine environments, that can permit reloading while at sea, and that can be simply and safely integrated into a variety of naval vessels, land vehicles, fixed locations, and other such locations, as needed.

SUMMARY

Conventional missile launchers yield disadvantages addressed by various exemplary embodiments of the present invention. Various exemplary embodiments provide a missile launcher having a pedestal operable to mount to a surface; and launcher box or container attached to the pedestal, the launcher box creating an environmental seal for missiles and missile canisters disposed therein. In additional embodiments, the missile launcher further includes wire rope isolators installed in a shear configuration, securing the launcher box to the pedestal; a base plate of the launcher box having at least one canister saddle attached thereto; and a plurality of upper clamps; fore and aft plates; a seal ring; an O-ring; a removable top cover and a fore hatch.

The canister saddles have an indent for receiving the missile canisters. The upper clamps each has independently and removably attached to the canister saddle to secure a single missile canister thereunder. The aft plate is disposed on an aft end of the launcher box and has a plurality of aft end plate holes therethrough. The plurality of aft end plate holes align with the missile canisters. The fore plate is disposed on a forward end of the launcher box and having a plurality of forward end plate holes therethrough, the plurality of forward end plate holes aligning with the missile canisters.

The seal ring is disposed about forward and aft ends of each missile canister, aligning with the plurality of aft end plate holes and corresponding forward end plate holes. The O-ring is disposed between the seal ring and either the forward or aft plate. The removable top cover on the launcher box. The fore hatch is disposed on a forward end of the launcher box, hingeably attached to the launcher box to cover and uncover the forward plate. The rear hatch is disposed on an aft end of the launcher box, the rear hatch hingeably attached to the launcher box to cover and uncover the aft plate.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Various exemplary embodiments provide a missile launcher that affords simple and safe integration onto a naval vessel, for example. The missile launcher includes a box launcher intended to house and launch the missiles and a pedestal to support and orient the box launcher. The box launcher provides protection from the natural environment as well as protection from other threats to the system. The box launcher enables missiles not normally designed for a harsh marine environment to be deployed and operated therein. The missile launcher also enables the ability to load missiles while at sea. The missile launcher can be integrated into naval vessels, land vehicles, fixed locations and other installations, as needed.

While shipboard missile launchers are relatively common, the missile launcher, according to an inventive embodiment, adapts a man-portable missile system, such as the AGM-176 Griffin precision kinetic effects tube-launched munition, having comparatively minimal environmental protection for integration into a box launcher to install in a marine environment and deployed long-term (e.g., months at sea). In addition, the launcher box can be a universal design, so as to be installed in numerous locations, at numerous azimuth or elevation angles, and on different platforms.

Also, many missile systems, such as the Griffin, are not equipped for long-term exposure to a marine environment. The exemplary missile launcher includes a pedestal to protect missiles from the damaging effects of shipboard vibration, shock from wave slap and sea keeping conditions, as well as other wartime threats, such as nearby mine detonation and small arms fire.

Figure 1:
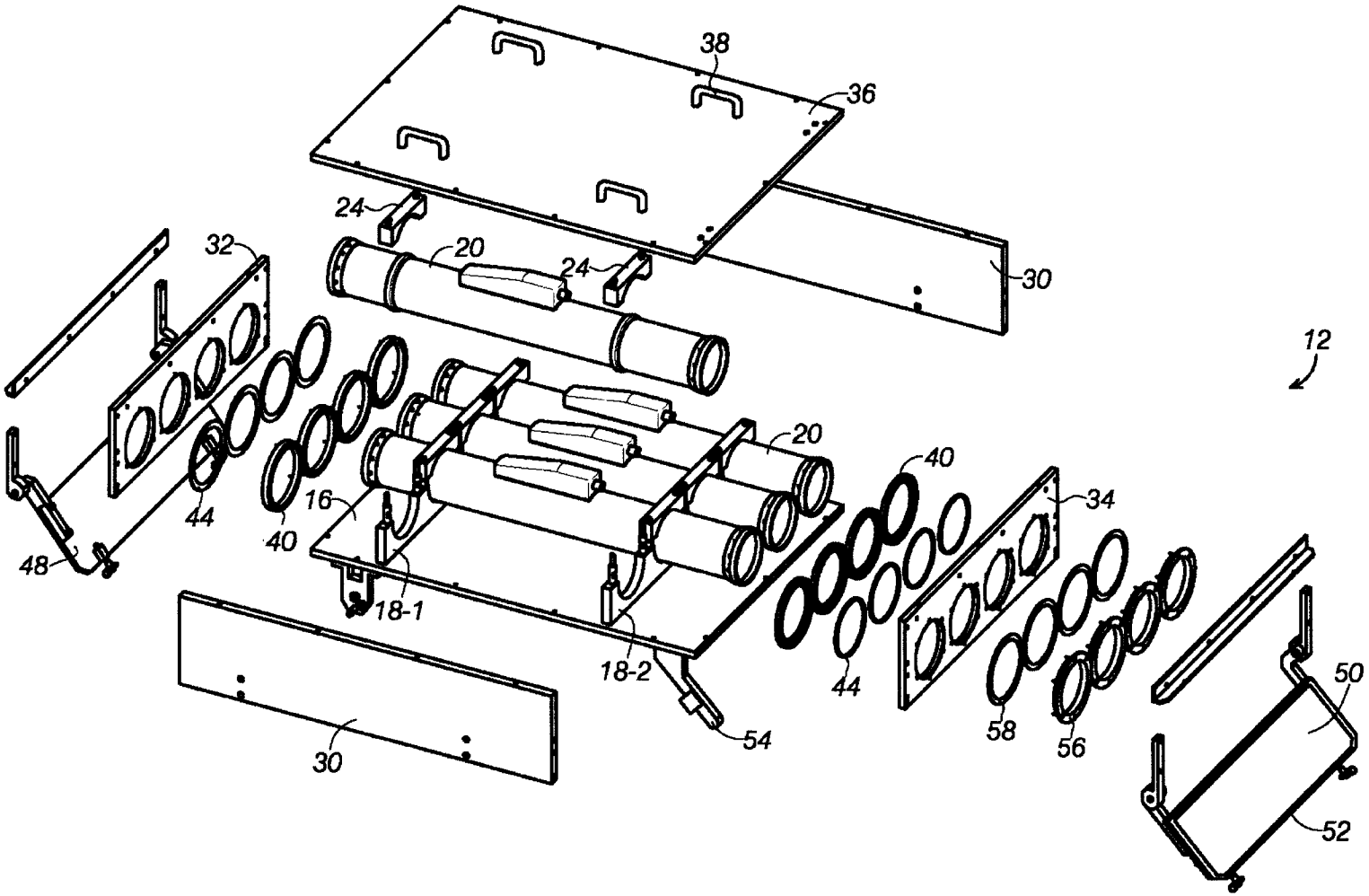
FIG. 1 is an exploded perspective view of a missile launcher.
Figure 2:
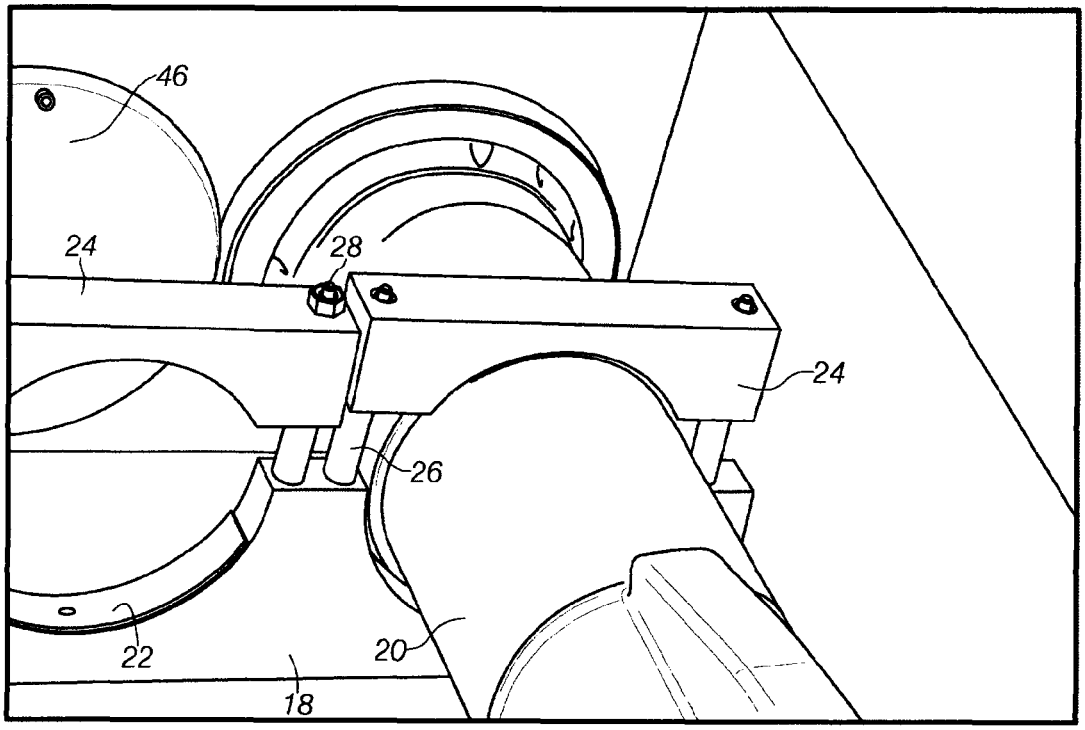
FIG. 2 is a is a detailed perspective view of a saddle and clamp used to hold a missile canister into the missile launcher.
Figure 3:
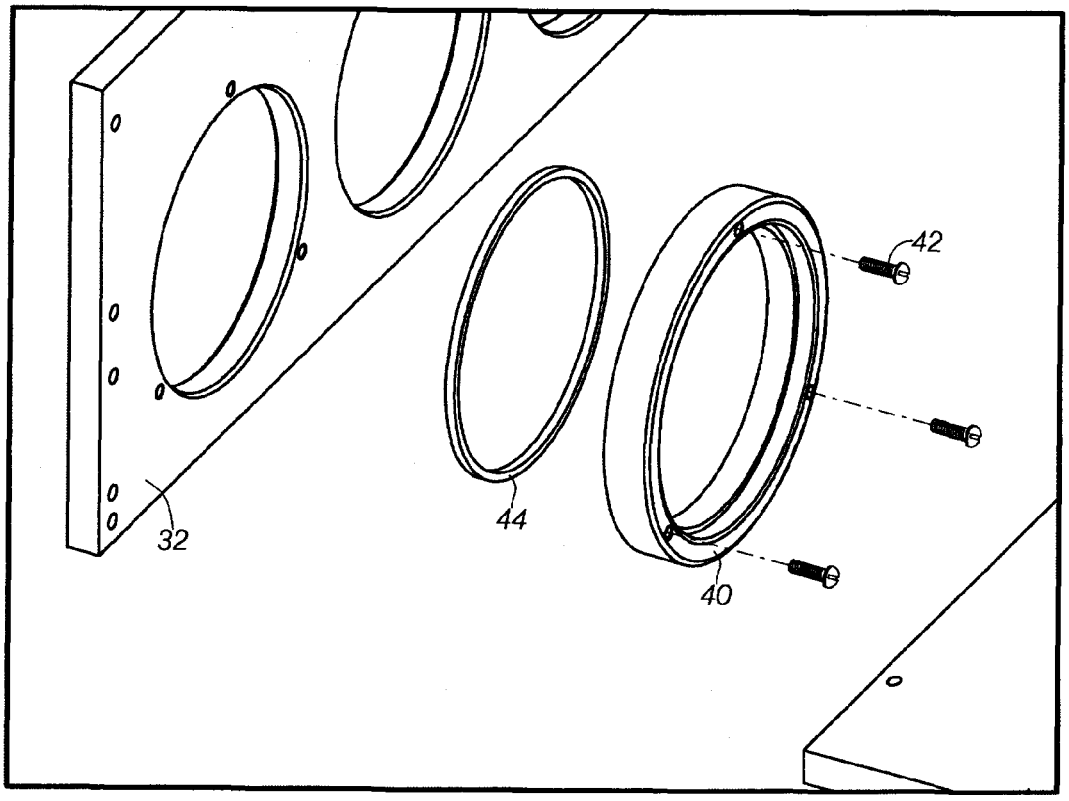
FIG. 3 is a detailed perspective view illustrating attachment of a forward seal ring on a forward launcher box plate off the missile launcher.
Figure 4:
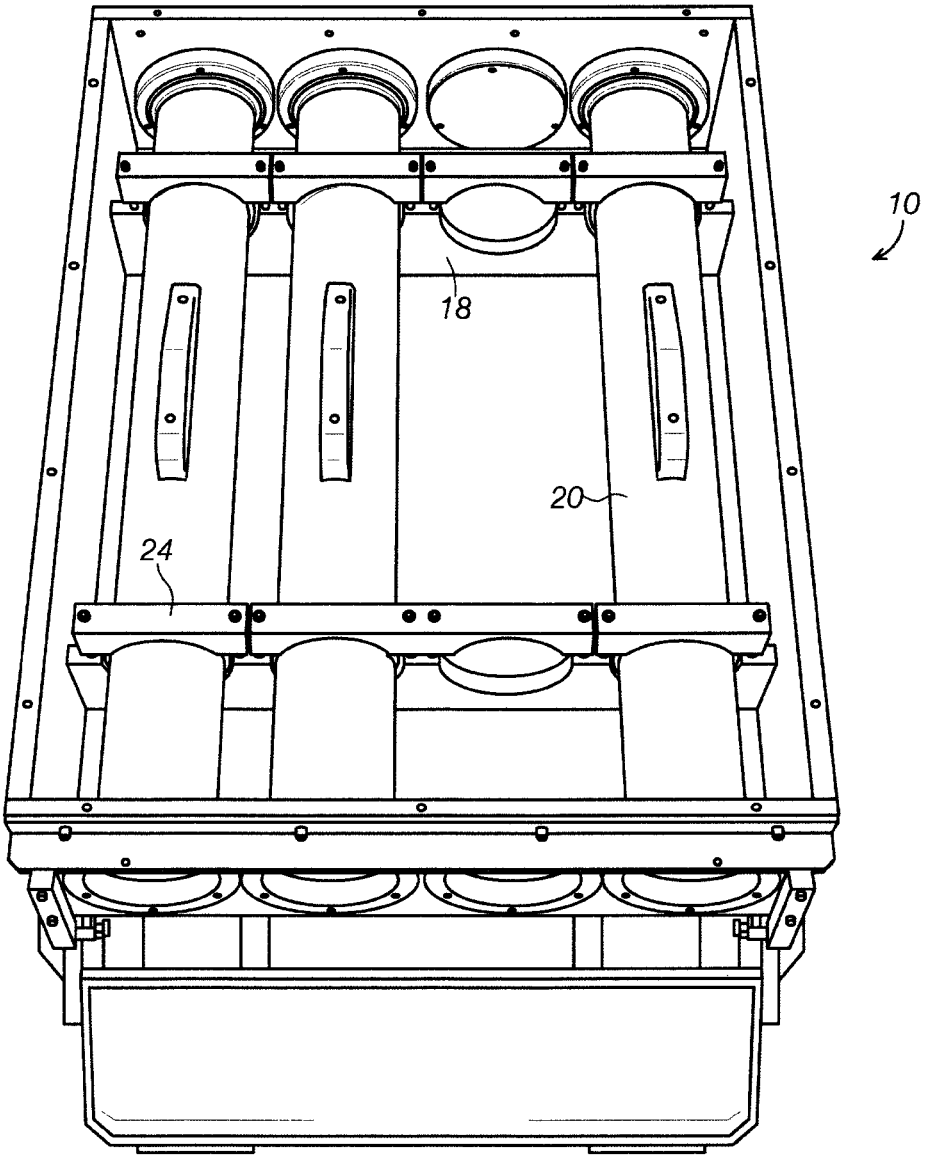
FIG. 4 is an aft plan perspective view of the missile launcher with rear hatch open and top cover removed.
Figure 5:
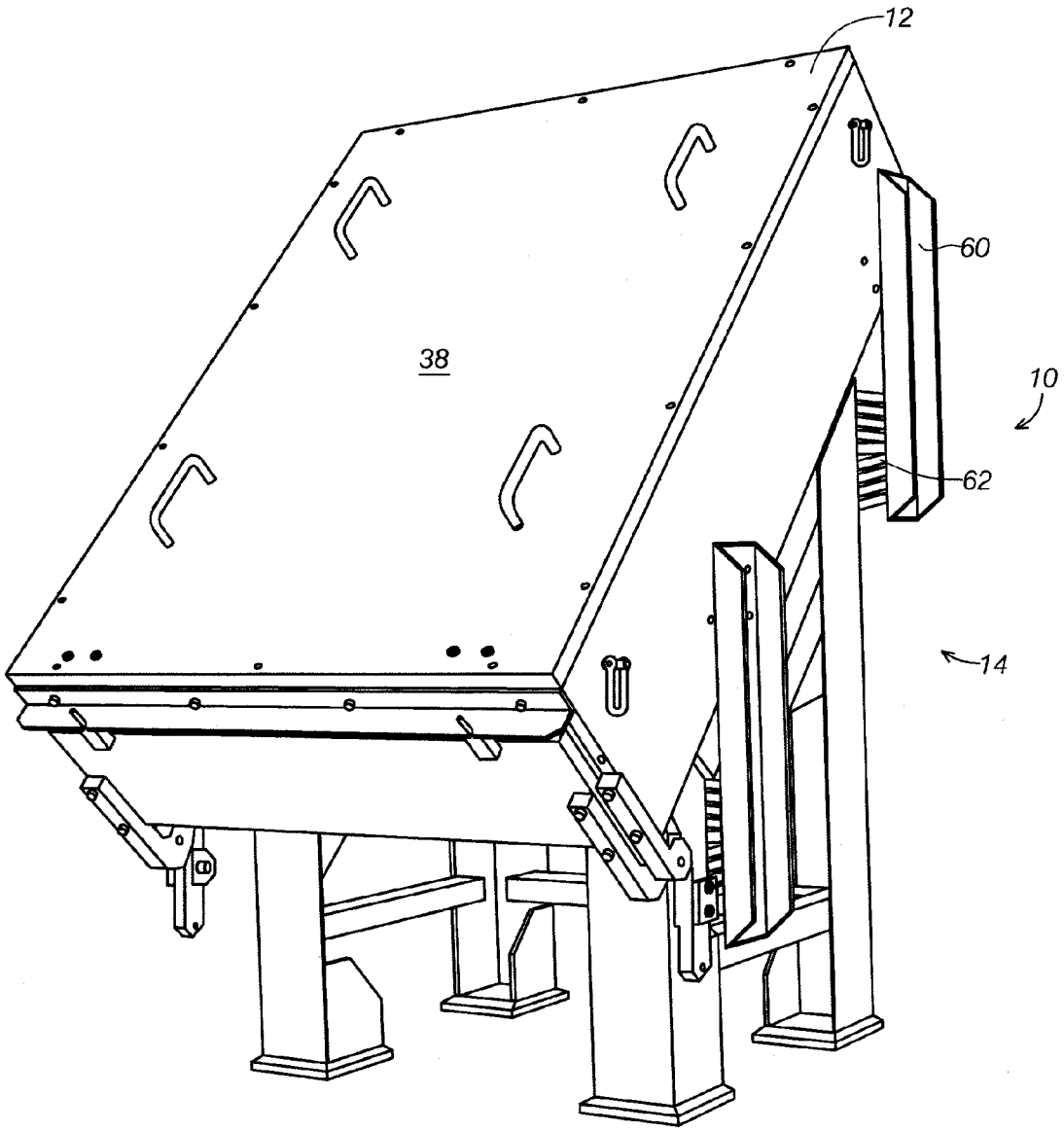
FIG. 5 is a perspective view of the missile launcher of attached to a pedestal.
Figure 6:
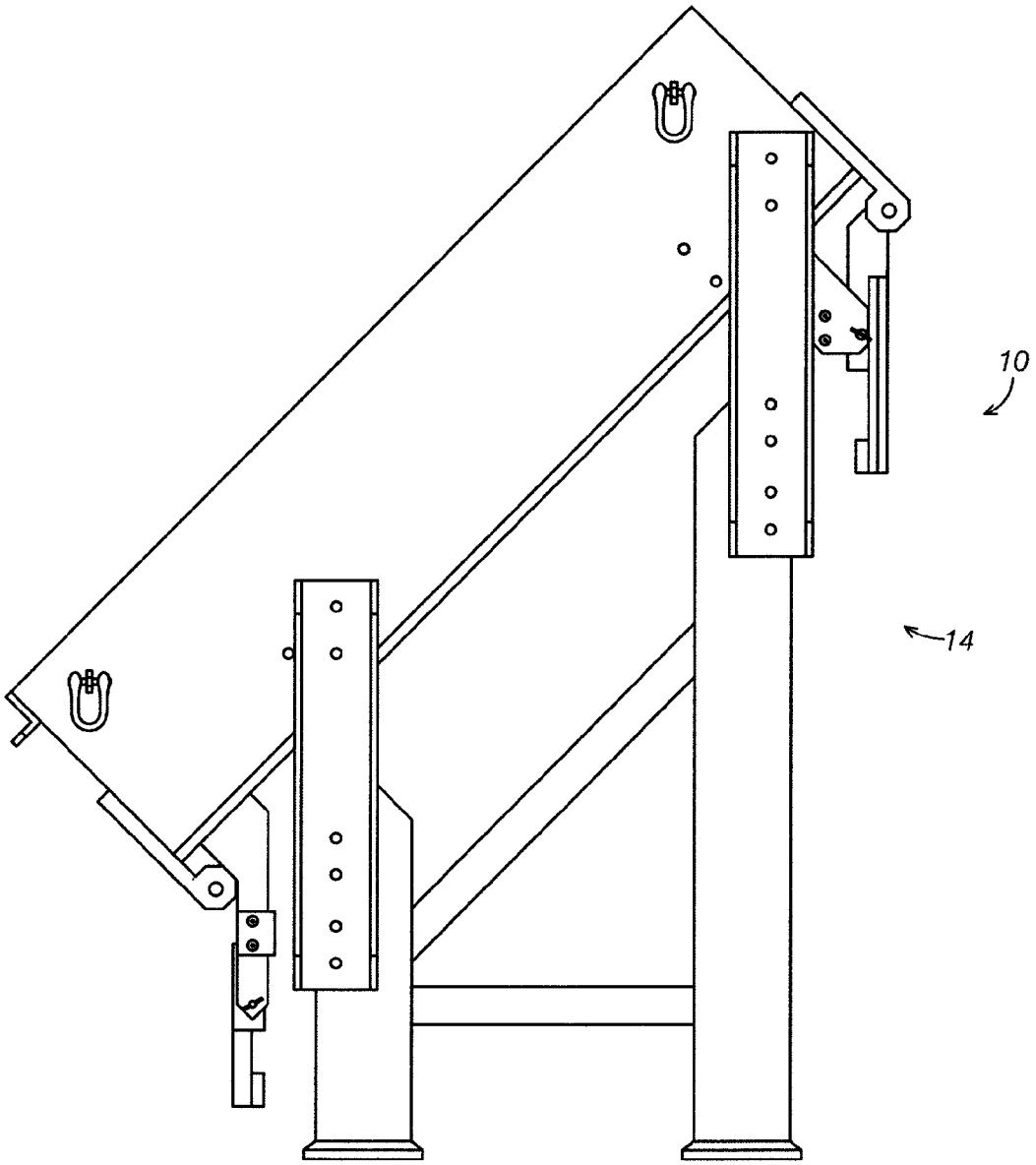
FIG. 6 is an elevation view of the pedestal mounted missile launcher.

FIGS. 1 through 6 show a missile system 10 including a launcher box or container 12 and a pedestal or mounting system 14. In particular, FIG. 1 shows an exploded perspective view of a missile launcher. FIG. 2 shows a detailed perspective view of a saddle and clamp used to hold a missile canister into the missile launcher. FIG. 3 shows a detailed perspective view illustrating attachment of a forward seal ring on a forward launcher box plate off the missile launcher. FIG. 4 shows an aft plan perspective view of the missile launcher of FIG. 1 with its rear hatch open and top cover removed. FIG. 5 shows perspective view of the missile launcher attached to a pedestal. FIG. 6 shows an elevation view of the pedestal mounted missile launcher.

FIG. 1 shows the disassembled components of the launcher box 12 in a perspective exploded view from fore (left) to aft (right). The launcher box 12 can include a bottom plate 16 supporting one or more canister saddles 18. Typically, the canister saddles 18 include a forward canister saddle 18-1 and an aft canister saddle 18-2. The canister saddles 18 can be fixed to the bottom plate 16 and can include a plurality of indents shaped to receive a missile canister 20 therein.

As shown in FIG. 2, the canister saddles 18 can be lined with a layer of a resilient material 22, such as neoprene foam, to cushion the missile canister 20 and to compensate for any manufacturing tolerances in either the missile canister 20 or the canister saddles 18.

An upper clamp 24 can be installed over each of the indents formed along the canister saddle 18. The upper clamp 24 can be removably secured to the canister saddle 18 by various mechanisms. For example, a support post 26 may extend from the canister saddle 18 and pass through the upper clamp 24, permitting a nut 28, or the like, to secure the upper clamp 24 on the support post 26. Of course, other attachment means can be contemplated within the scope of the inventive concepts herein, provided that the upper clamp 24 is removeable from the canister saddle 18 to permit loading, unloading or reloading of the canister 20 into the launcher box 12. Separate upper clamps 24 can be used for each of the canisters 20, facilitating installation or removal of one canister at a time, ensuring that an operator need not concurrently contend with multiple loose missiles.

Side walls 30 can extend from opposite sides of the bottom plate 16 of the launcher box 12. A forward plate 32 can extend from a forward end of the bottom plate 16 and an aft plate 34 can extend from an aft end of the bottom plate 16. These side walls 30, forward plate 32, and aft plate 34 can be permanently affixed and sealed to the bottom plate 16 in order to inhibit intrusion into the launcher box 12.

A top cover 36 (shown as a plate similar to the bottom plate 16) can removably attach to the side walls 30, forward plate 32, and aft plate 34. The top cover 36 can include one or more handles 38 to help removing and attaching the top cover 36. The top cover 36 can attach to the launcher box 12 by various techniques, such as with socket head cap screws, eye nuts on swing bolts, or the like. A seal (not shown) can be disposed between the top cover 36 and the periphery of the launcher box 12 to prevent water or other substance intrusion into box interior.

For each canister 20, a seal ring 40 can be disposed on each end thereof. The canister 20 is disposed onto the canister saddles 18. Then a seal ring 40 at each end can be moved toward the forward plate 32 to the left and the aft plate 34 to the right and attached thereto with a removable attachment mechanism, such as a set of screws 42, for example, as shown in FIG. 3. An O-ring 44 can be disposed between the seal ring 40 and the associated plates 32 and 34, prior to securing the assembly with the screws 42.

When a canister 20 is not installed in one of the locations (indents) along the canister saddle 18, a blanking plate 46 can be disposed over the appropriate opening in the forward plate 32 and the aft plate 34. The blanking plate 46 can mount to either the forward plate 32 or else the aft plate 34 by the screws 42 and with the O-ring 44 disposed therebetween.

A fore hatch 48 can hingeably attach to cover and uncover the forward plate 32. Similarly, a rear hatch 50 can hingeably attach to cover and uncover the aft plate 34. A seal 52 may be disposed about an inner perimeter of the fore hatch 48 and the rear hatch 50 to help seal the fore hatch 48 to the forward plate 32, and the rear hatch 50 to the aft plate 34.

A hatch restraint 54 can secure the fore hatch 48 and the rear hatch 50 to remain in an open configuration. An electrical switch associated with the restraint 54 can produce an indicator signal (for an operator display monitor) that the fore hatch 48 and the rear hatch 50 are open or closed, depending on deployment of the restraint 54 as secured or not. This electrical signal may be supplied to a launching system computer (not shown) to prevent launch of a missile with either or both of the hatches 48 and 50 in a closed position.

In some embodiments, a protective ring 56 can be attached to the outside surface of the aft plate 34. A gasket 58 can be disposed between the protective ring 56 and the aft plate 34. The protective ring 56 can help protect the aft plate 34 from hot missile exhaust when a missile is launched. While the drawings show the canister saddles 18 disposed at particular locations on the bottom plate 16, depending on the canister to be mounted in the launcher box 12, the number of and location of the canister saddles 18 can vary. In some embodiments, the canister saddles 18 can be integrated with the seal rings 40, thereby combining the environmental sealing with the mechanical restraint at the same location.

FIG. 5 illustrates the launcher box 12 as including a plurality of legs 60 extending from sides thereof. The legs 60 of the launcher box 12 can attach to the pedestal 14 with wire rope shock isolators 62 mounted in the direct shear orientation. The orientation and location of the wire rope shock isolators 62 can achieve the narrowest launcher footprint to eliminate the need for lateral stabilizers, which are not possible to incorporate in a free-standing system. While the pedestal 14 is shown as a four post design, other designs can be used for the pedestal, such as structural beams disposed over an open span.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A missile launch assembly for securing at least one missile within and launching said missile from a corresponding missile canister deployed on a vessel, said assembly comprising:

a pedestal operable to mount to a surface of the vessel;

a launcher box attached to said pedestal, said launcher box having forward and aft ends and including fore and rear hatches; and wire rope isolators installed in a shear configuration for securing said launcher box to said pedestal, wherein said fore hatch being hingeably attachable to said forward end of said launcher box to be positionable in close and open positions to respectively cover and uncover said forward end, said rear hatch being hingeably attachable to said aft end of said launcher box, to be positionable in close and open positions to respectively cover and uncover said aft end, said launcher box environmentally seals the missile canister and the missile disposed therein while said fore and rear hatches respectively cover said forward and aft ends, and said launcher box enables launch of the missile while said fore and rear hatches respectively uncover said forward and aft ends.

2. The missile launch assembly of claim 1, further comprising:

a base plate of said launcher box having at least one canister saddle attached thereto, said canister saddle having an indent for receiving the missile canister; and a plurality of upper clamps, each upper clamp independently and removably attaching to said canister saddle to secure the corresponding missile canister thereunder.

3. The missile launch assembly of claim 1, further comprising:

an aft plate disposed between said aft end of said launcher box and said rear hatch, said aft plate having an aft end plate hole therethrough, said aft end plate hole aligning with the missile canister;

a forward plate disposed between said forward end of said launcher box and said fore hatch, said forward plate having a forward end plate hole therethrough, said forward end plate hole aligning with the missile canister;

fore and aft seal rings disposed respectively about forward and aft ends of each missile canister, each seal ring aligning with corresponding said aft and forward end plate holes; and fore and aft O-rings disposed between respective said fore and aft seal rings and said forward and aft plates.

4. The missile launch assembly of claim 3, further comprising an attachment mechanism for removably attaching said seal ring to said plate with said O-ring sandwiched therebetween.

5. The missile launch assembly of claim 1, further comprising a seal disposed about an inner periphery of said fore and rear hatches.

6. The missile launch assembly of claim 1, further including a restraint that maintains said fore and rear hatches being in an open position, and a switch responsive to said restraint initiating said open position for said fore and rear hatches.

7. The missile launch assembly of claim 3, further comprising:

a protective ring disposed on an outer surface of said aft plate about each of said aft end plate holes; and a gasket disposed between said protective ring and said aft plate.

8. A missile launch assembly for securing at least one missile within and launching said missile from a corresponding missile canister deployed on a vessel, said assembly comprising:

a pedestal operable to mount to a surface of the vessel;

a launcher box attached to said pedestal, said launcher box creating an environmental seal for the missile canister containing the corresponding missile disposed therein;

wire rope isolators installed in a shear configuration, securing said launcher box to said pedestal;

a base plate of said launcher box having at least one canister saddle attached thereto, said canister saddle having an indent for receiving the missile canister;

at least one upper clamp for removably attaching to corresponding said canister saddle to secure the missile canister thereunder;

an aft plate disposed on an aft end of the launcher box and having an aft end plate hole therethrough corresponding to and aligning with the missile canister;

a forward plate disposed on a forward end of the launcher box and having a forward end plate hole therethrough corresponding to and aligning with the missile canister;

a seal ring disposed about forward and aft ends of the missile canister, said seal ring aligning with said aft end plate hole and said forward end plate hole;

an O-ring disposed between said seal ring and one of said forward plate and said aft plate;

a removable top cover on the launcher box;

a fore hatch disposed on said forward end of said launcher box, said fore hatch hingeably attached to said launcher box to cover and uncover said forward plate; and a rear hatch disposed on an aft end of said launcher box, said rear hatch hingeably attached to said launcher box to cover and uncover said aft plate.

9. The missile launch assembly of claim 8, further comprising a removable attachment mechanism for removably attaching said seal ring to one of said forward and aft plates with said O-ring sandwiched therebetween.

10. The missile launch assembly of claim 8, further comprising a seal disposed about an inner periphery of one of said fore hatch and said rear hatch.

11. The missile launch assembly of claim 8, further including a restraint that maintains said fore and rear hatches being in an open position, and a switch responsive to said restraint initiating said open position for said hatches.

12. The missile launch assembly of claim 8, further comprising:

a protective ring disposed on an outer surface of said aft plate about each of said aft end plate holes; and a gasket disposed between said protective ring and said aft plate.

* * * * *